US010378822B2

(12) United States Patent
Ma et al.

(10) Patent No.: US 10,378,822 B2
(45) Date of Patent: Aug. 13, 2019

(54) HEATING DEVICE FOR ANNULAR COMPONENT AND ANNULAR CAVITY THEREOF

(71) Applicant: BEIJING GOLDWIND SCIENCE & CREATION WINDPOWER EQUIPMENT CO., LTD., Beijing (CN)

(72) Inventors: Shengjun Ma, Beijing (CN); Chengqian Liu, Beijing (CN)

(73) Assignee: BEIJING GOLDWIND SCIENCE & CREATION WINDPOWER EQUIPMENT CO., LTD., Beijing (CN)

( * ) Notice: Subject to any disclaimer, the term of this patent is extended or adjusted under 35 U.S.C. 154(b) by 291 days.

(21) Appl. No.: 15/107,389

(22) PCT Filed: Dec. 11, 2014

(86) PCT No.: PCT/CN2014/093630

§ 371 (c)(1),
(2) Date: Jun. 22, 2016

(87) PCT Pub. No.: WO2015/096624

PCT Pub. Date: Jul. 2, 2015

(65) Prior Publication Data

US 2017/0003074 A1 Jan. 5, 2017

(30) Foreign Application Priority Data

Dec. 26, 2013 (CN) ..... 2013 1 0733579

(51) Int. Cl.
*F27B 17/00* (2006.01)
*F27D 7/02* (2006.01)
(Continued)

(52) U.S. Cl.
CPC ..... *F27B 17/0083* (2013.01); *C21D 1/34* (2013.01); *C21D 1/767* (2013.01); *C21D 9/40* (2013.01);
(Continued)

(58) Field of Classification Search
CPC .. C21D 1/34; C21D 1/767; C21D 9/40; F27B 17/00; F27B 17/0016; F27B 17/0083; F27D 2007/045; F27D 7/02; F27D 7/04
(Continued)

(56) References Cited

U.S. PATENT DOCUMENTS 4,044,950 A * 8/1977 Engeling ..... F28D 21/0008 126/110 R
5,556,593 A * 9/1996 Grenier ..... C21D 9/0037 266/250
2019/0003771 A1* 1/2019 Ma ..... F27D 7/04

FOREIGN PATENT DOCUMENTS

CN 101285648 A 10/2008
CN 201679871 U 12/2010
(Continued)

OTHER PUBLICATIONS

The Extended European Search Report dated Sep. 20, 2017; Appln. No. 14875308.0-1373/3093353 PCT/CN2014093630.
(Continued)

*Primary Examiner* — Scott R Kastler
*Assistant Examiner* — Michael Aboagye
(74) *Attorney, Agent, or Firm* — Ladas & Parry LLP

(57) ABSTRACT

A heating device for an annular component is provided. The heating device is configured to heat the annular component via hot gas flow, and includes a gas flow heater, a draught fan, and an annular cavity for accommodating the annular component. An outer wall of the annular cavity is provided with a gas flow inlet and a gas flow outlet, the gas flow heater heats a gas flow, and the draught fan enables the gas flow to enter into the gas flow inlet, pass through a gas flow passage in the annular cavity, and be discharged via the gas flow outlet.

11 Claims, 5 Drawing Sheets

(51) Int. Cl.

| | |
|---|---|
| ***F27D 7/04*** | (2006.01) |
| ***C21D 9/40*** | (2006.01) |
| ***C21D 1/34*** | (2006.01) |
| ***C21D 1/767*** | (2006.01) |

(52) U.S. Cl.
CPC ..... *F27B 17/00* (2013.01); *F27B 17/0016* (2013.01); *F27D 7/02* (2013.01); *F27D 7/04* (2013.01); *F27D 2007/045* (2013.01)

(58) Field of Classification Search
USPC ..... 266/140, 257, 249, 250, 252; 148/601, 148/657; 432/137, 138, 144, 143, 145
See application file for complete search history.

(56) References Cited

FOREIGN PATENT DOCUMENTS

| | | | |
|---|---|---|---|
| CN | 102659460 | A | 9/2012 |
| CN | 103088200 | A | 5/2013 |
| CN | 103725863 | A | 4/2014 |
| CN | 203700442 | A | 7/2014 |
| EP | 2666875 | A1 | 11/2013 |
| GB | 1431753 | A | 4/1976 |
| JP | 01260289 | A | 10/1989 |

OTHER PUBLICATIONS

First Chinese Office Action dated Dec. 1, 2014; Appln. No. 201310733579.8.
International Search Report dated Mar. 11, 2015; PCT/CN2014/093630.

* cited by examiner

HEATING DEVICE FOR ANNULAR COMPONENT AND ANNULAR CAVITY THEREOF

FIELD

The present application relates to a heating device and an annular cavity thereof, and in particular to a heating device taking gas as a heat exchanging medium to heat an annular component, and an annular cavity of the heating device.

BACKGROUND

For heating a large annular component (for example, in the shrink fit process of a bearing, a large bearing is required to be heated), the oil bath heating, the electromagnetic induction heating via an eddy current, and the air heating are methods commonly used. Among the above heating methods, the air heating is mostly used. Taking an air heating furnace used in the shrink fit process of the bearing as an example, the air heating furnace takes hot air as a heat transfer medium, to heat a surface of a shrink fit bearing component, and the heating method is mainly the convective heat transfer, which is supplemented by the radiation heat transfer.

As shown in FIG. 1, FIG. 1 is a schematic view showing the structure of an air heating furnace in the conventional technology, and FIG. 1 shows the structure of a typical heating furnace used for shrink fit of the bearing component used in the present industries. The air heating furnace includes an upper part and a lower part, namely a furnace lid 81*a* and a furnace base 82. In the conventional technology, a heating furnace body is formed by welding a sectional steel and a steel plate, engineering material with heat insulation property (rock wool of aluminum silicate fiber, etc.) is filled between a furnace flue and a protective shell through tiling and overlapping to be used as a furnace liner for heat insulation. A furnace motor 83 is provided at a center position at the top of the furnace lid 81, the motor is fixed via a flange, and the furnace motor drives a centrifugal fan 86 to provide power for circulation and flowing of air. A flow guiding plate is provided below the centrifugal fan 86, and the flow guiding plate and an inner wall of the furnace lid 81 form a radial flow channel part of an upper air flow passage. An annular lower flow guiding plate 85, which is coaxial with a vertical portion of the upper flowing guiding plate, is provided in the furnace base 82, and after the furnace lid 81 and the furnace base 82 are engaged, the upper flow guiding plate 84 and the lower flow guiding plate 85 can abut against each other inside the heating furnace to form an annular air flow passage. A channel beam is adopted as a base frame of the furnace base 82, to enhance the uniformity of a temperature of the furnace. Gaps with uniform heights are arranged between the lower flow guiding plate 85 and an inner wall of the furnace base 82, to allow air flow coming from the furnace lid 81 to pass through an annular gap to enter an area where the heated bearing component is located via the gaps with uniform heights of the furnace base 82 (as shown by arrows in FIG. 1). In an annular area encircled by the upper flow guiding plate 84 and the lower flow guiding plate 85, the air flow is converged to a suction port of the centrifugal fan 86 after releasing heat to the surface of the bearing component. Generally, a certain number of electric heating elements are provided in the radial flow channel in the furnace lid 81 as heaters 87 to heat the air flow, and the electric heating elements are uniformly distributed along a periphery of the radial flow channel. The heated large bearing component is supported by multiple points to be placed on the furnace base 82, and coaxial with the lower flow guiding plate 85, and is equally spaced from the lower flow guiding plate 85.

A basic structure of the air heating furnace in the conventional technology is described above, and in the process of carrying out the present application, the inventor found that the air heating furnace in the conventional technology has the following disadvantages:

1. There is waste in the air flow passage.

With the increase of a radial dimension of the bearing, the space of a center area within an annular area of the bearing component may increase as well, and in the case that the radial dimension of the bearing increases to an order magnitude of several meters, when such a bearing component is heated, the air in the space of the center area does not participate in the convective heat exchange between the surface of the bearing and the hot air, therefore there is huge waste in the air flow passage. Also, with the increase of the dimension of the bearing, for allowing the air flow to fully flow, the power of a drive motor of a fan is required to increase accordingly, and a power consumption increases as well.

2. There is waste in material for manufacturing the heating device.

Viewed from an axial direction of the heating furnace of a cylinder shape, the material used in center areas of the furnace lid 81 and the furnace base 82 is not necessary, especially the heat insulation material used in these areas. Also, due to the increase of the overall structure, for ensuring the strength, the dimension of a main beam structure of the furnace body may be increased, and the material consumed may be further increased, thus sharply increasing the manufacturing cost.

3. There is a warping problem after the heating furnace being heated via an eddy current.

The bearing with a large dimension has a large diameter and a large mass (greater than several tons), and a warping problem caused by non-uniform heating may occur to the bearing after the bearing being heated via the eddy current, thus a good assembling quality cannot be assured. In addition, due to remnant magnetism in the component with a large dimension, the component cannot be normally used in a subsequent long term.

4. Transportation is limited due to the increase of dimension of the heating furnace.

The structural dimension of the furnace body is limited, and a structural dimension of the space in the furnace body of a traditional hot air flow heating furnace increases with the increase of the radial dimension of a heated annular work piece (large bearing), resulting in an increase of the manufacturing cost; and the transportation of the heating furnace with an oversize width is restricted.

5. There are hidden risks in health and safety in the hot oil bathing heating method.

The traditional bearing heating method of hot oil bathing has health and safety problems (fire risk exists), furthermore, issues of dealing with the environment and the oil should also be considered, thus the cost is high; the bearing is apt to be contaminated, and a new bearing may destroy a protective oil.

SUMMARY

A first object of the present application is to provide a heating device for an annular component and an annular cavity of the heating device, to reduce waste in a gas flow passage.

A second object of the present application is to provide a heating device for an annular component and an annular cavity of the heating device, to reduce waste in material for manufacturing the heating device.

A third object of the present application is to provide a heating device for an annular component and an annular cavity of the heating device, to reduce the warping problem occurring after an annular component is heated by an eddy current.

A fourth object of the present application is to provide a heating device for an annular component and an annular cavity of the heating device, to overcome the limited transportation problem caused by an increased size of the heating furnace.

A fifth object of the present application is to provide a heating device for an annular component and an annular cavity of the heating device, to avoid the hidden risks in health and safety in the hot oil bathing heating method.

To realize the above objects, a heating device for an annular component is provided according to the present application, which heats the annular component via hot gas flow, and includes a gas flow heater and a draught fan. The heating device further includes an annular cavity for accommodating the annular component, an outer wall of the annular cavity is provided with a gas flow inlet and a gas flow outlet, the gas flow heater heats the gas flow, and the draught fan enables the gas flow to enter into the gas flow inlet, pass through a gas flow passage in the annular cavity, and be discharged from the gas flow outlet.

By adopting a structure of the annular cavity, the heating device for the annular component saves a gas flow circulation passage of a center area encircled by the annular component, and enables the gas flow passage to be concentrated near the annular component, thus allowing heat exchange to be more efficient, and waste of heat energy to be reduced. In addition, the material consumed for manufacturing the heating device is reduced and the manufacturing cost is decreased.

An annular cavity of a heating device is further provided according to the present application, the annular cavity accommodates a heated annular component, and an outer wall of the annular cavity is provided with a gas flow inlet and a gas flow outlet.

Compared with a furnace cavity of a heating furnace in the conventional technology, the annular cavity of the heating device according to the present application saves the gas flow circulation passage of the center area encircled by the annular component and allows the gas flow passage to be concentrated near the annular component, thus allowing the heat exchange to be more efficient, and waste of heat energy to be reduced. In addition, compared with the furnace cavity of the heating furnace in the conventional technology, the space occupied by the furnace cavity in the present application is greatly reduced, the material consumed for manufacturing the furnace body is reduced, and the manufacturing cost is decreased, and the furnace having this furnace cavity is not restricted by an over-wide transportation, which especially fits the requirements of a movable plant, and meets the requirements for portable tooling of the assembly of a large generator.

DETAILED DESCRIPTION

Improvements are made to the overall structure of the heating device of the annular component in the conventional technology according to the present application, to change the structure of the conventional disk-type furnace into a structure of annular cavity, and further designs and improvements are made based on the annular cavity structure. A heating device for an annular component according to the present application is described in detail via embodiments hereinafter.

First Embodiment

Figure 2:
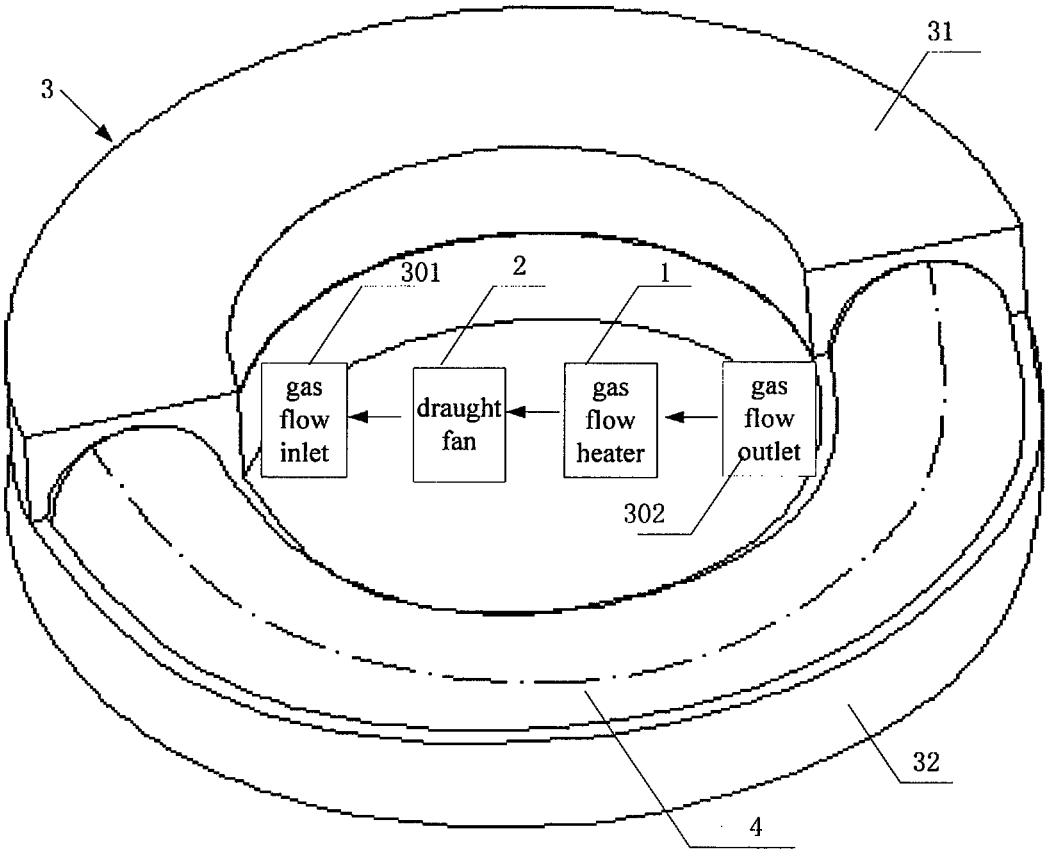
FIG. 2 is a schematic view showing the structure of a heating device for an annular component according to a first embodiment of the present application.

As shown in FIG. 2, FIG. 2 is a schematic view showing the structure of a heating device for an annular component according to a first embodiment of the present application. The heating device for the annular component according to this embodiment heats the annular component via hot gas flow, includes a gas flow heater 1, and a draught fan 2, and further includes an annular cavity 3 for accommodating an annular component 4. An outer wall of the annular cavity is provided with a gas flow inlet 301 and a gas flow outlet 302, and the gas flow heater 1 heats the gas flow. The draught fan 2 enables the gas flow to enter into the gas flow inlet 301, pass through a gas flow passage in the annular cavity 3 and be discharged from the gas flow outlet 302. For showing an interior structure of the annular cavity 3, a half of an upper annular cavity 31 is removed in FIG. 2, to show the state after the annular component 4 is placed inside the annular cavity 3.

Figure 1:
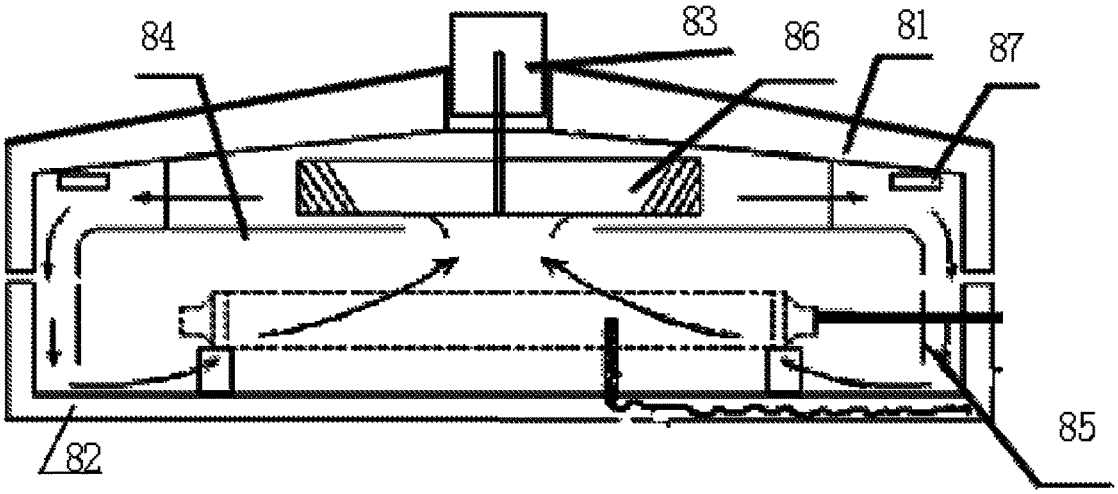
Fig. 1 (Prior Art)
FIG. 1 is a schematic view showing the structure of an air heating furnace in the conventional technology.

The structure of the heating device according to this embodiment is embodied as an annular cavity, compared with a heating furnace in the conventional technology, such structure saves an circulation passage of the gas flow in a center area encircled by the annular component 4, and allows the gas flow passage to be concentrated near the annular component 4, thereby allowing heat exchange to be more efficient, and reducing waste of heat energy. In addition, since the annular cavity is adopted, the circulation passage of the gas flow is reduced, and power of the draught fan required to drive the gas flow to flow is reduced as well. Furthermore, since the annular cavity is adopted, the parts, corresponding to the center area of the annular component 4, of a furnace lid 81 and a furnace base 82 (as show in FIG. 1), in a heating furnace in the conventional technology are saved, thus reducing material consumed in manufacturing the heating device, and reducing the manufacturing cost. Moreover, the manufacture is not limited by a radial dimension, etc. of the annular component, therefore the manufacturing cost can be greatly decreased, and the manufacturing cost and the material consumption can be reduced by half.

The annular cavity according to this embodiment of the present application may adopt any openable structure or any detachable structure, as long as the heated annular component 4 can be arranged in an inner cavity of the annular cavity 3. In addition, the annular cavity may also be individually customized according to a single annular component, which is not limited in the present application.

Preferably, the annular cavity 3 is formed by engaging the upper annular cavity 31 and a lower annular cavity 32. As shown in FIG. 2, in this embodiment, the annular cavity 3 is of a circular ring shape, and a cross section of the annular cavity 3 is of a circular shape, the annular cavity is divided, along a plane in a radial direction of the annular cavity, into the upper annular cavity 31 and the lower annular cavity 32 each having a U-shaped cross section in a vertical direction.

In practical application, the upper annular cavity 31 is removed, and the annular component 4 is placed in the inner cavity of the lower annular cavity 32, and then the upper annular cavity 31 and the lower annular cavity 32 are engaged to form the closed annular cavity 3. Preferably, the upper annular cavity 31 is formed by engaging multiple upper annular cavity units, and the lower annular cavity 32 is formed by engaging multiple lower annular cavity units. In use, the multiple upper annular cavity units and the multiple lower annular cavity units are engaged to form an integral annular cavity. For example, the upper annular cavity 31 may be split along the annular circumferential direction of the annular cavity 3 into two same semicircular shaped upper annular cavity units, the state shown in FIG. 2 may be considered as the state in which one of the upper annular cavity units is removed. Similarly, the lower annular cavity unit 32 may also be split into two same lower annular cavity units.

With such an openable or a detachable structure, it is easy to fit the annular component 4 into the annular cavity 3, furthermore the transportation is facilitated, and the problem of the radial dimension of the heating furnace in the conventional technology exceeding a limited width of road transportation is addressed, thus satisfying the requirement for a movable transportation.

Moreover, the gas flow inlet 301 and the gas flow outlet 302 may be arranged at any portion of the annular cavity 3, and positions of the gas flow heater 1 and the draught fan 2 may also be flexibly set, the gas flow heater 1 and the draught fan 2 may be arranged outside the annular cavity and may also be arranged inside the annular cavity according to the requirements, and multiple gas flow heaters 1 and draught fans 2 may also be provided as required.

Preferably, the gas flow heater 1 heats the gas flow before the gas flow enters into the gas flow passage of the annular cavity, that means, the gas flow heater 1 is arranged at an outer portion of the annular cavity, or is arranged at an inner portion, corresponding to the gas flow inlet 301, of the annular cavity. And in the case that a closed gas flow circulation passage is formed, the gas flow heater 1 may also be arranged at an inner portion, corresponding to the gas flow outlet 302, of the annular cavity. With such a structure, the manner of heating the gas flow is simple, and the gas flow heater may not occupy the space of the gas flow passage inside the annular cavity.

More preferably, as shown in FIG. 2, the gas flow inlet 301 and the gas flow outlet 302 may be arranged in an outer wall of an inner ring of the annular cavity, the gas flow heater 1 and the draught fan 2 are arranged at an inner side of the annular cavity, and a closed gas flow circulation passage is formed between the gas flow inlet 301, the inner cavity of the annular cavity, the gas flow outlet 302, the draught fan 2 and the gas flow heater 1. With such a structure, a circulation path of the gas flow is minimum, the heat energy may be efficiently utilized, and the heat exchange may be fully achieved.

Furthermore, it is preferable that two gas flow passages of the same length are formed between the gas flow inlet 301 and the gas flow outlet 302 in the annular cavity 3. For example, as shown in FIG. 2, the gas flow inlet 301 and the gas flow outlet 302 are arranged in the outer wall of the inner ring of the annular cavity 3, and are located in a same diameter of the annular cavity 3. In this way, the two gas flow passages of the same length are formed from the gas flow inlet 301 to the gas flow outlet 302 around an axial direction of the annular component 4. With such a structure, temperature changes and flow rates of the gas flow in the two gas flow passages are approximately same, which facilitates an uniform control to the gas flow, and enables heating conditions of the annular component in the two gas flow passages to be uniform.

In this embodiment, air can be adopted as a heat exchanging medium, an air flow filter may further be provided at the gas flow outlet 302, and filtered air is taken as the heat transfer medium, thus can protect a surface of the bearing from contamination.

In addition, the annular cavity according to this embodiment may be of any annular shape such as an ellipse annular shape, a rectangle annular shape, or a triangle annular shape, thus various special annular components 4 of non-circular ring shape can be heated. The gas as the heat exchanging medium is not limited to the air, for example, natural gas may also be used as a high temperature heat transfer medium. Besides, other gas-solid separation devices may also be adopted to filter the gas flow.

Furthermore, the heating device according to this embodiment may adopt heat insulation technology, for example, a material with high heat insulation property may be adopted to manufacture the annular cavity, etc., thus improving the heating efficiency of the annular component 4, and further saving the energy.

Second Embodiment

In addition to the improvement made to the overall structure, further improvement is made to an interior of the annular cavity according to this embodiment of the present application.

Figure 3:
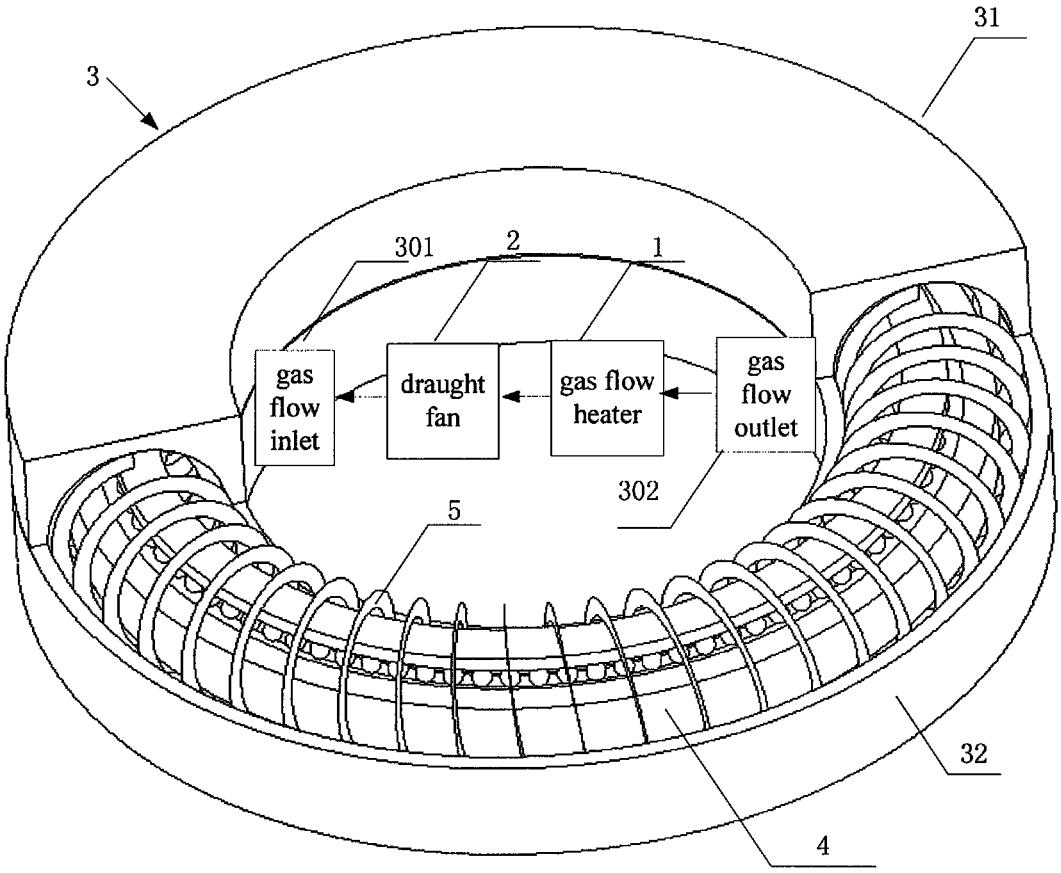
FIG. 3 is a schematic view showing the structure of a heating device for an annular component according to a second embodiment of the present application.

FIG. 3 is a schematic view showing the structure of a heating device for an annular component according to a second embodiment of the present application. As shown in FIG. 3, based on the first embodiment, a guiding member is provided in the annular cavity 3, the guiding member enables the gas flow to move along the surface of the annular component. By providing the guiding member in the annular cavity 3, a flowing manner of the gas flow is controlled, thus allowing the annular component to be uniformly heated, and improving the heating efficiency.

Preferably, the guiding member is embodied as a guiding spiral rib structure 5, and the guiding spiral rib structure 5 allows a track of the hot air flow entering into the annular cavity to change into a spiral pipe shaped movement around the annular component 4 (such as the large bearing component shown in FIG. 3), thus the annular component 4 can be more efficiently and uniformly heated.

Figure 4:
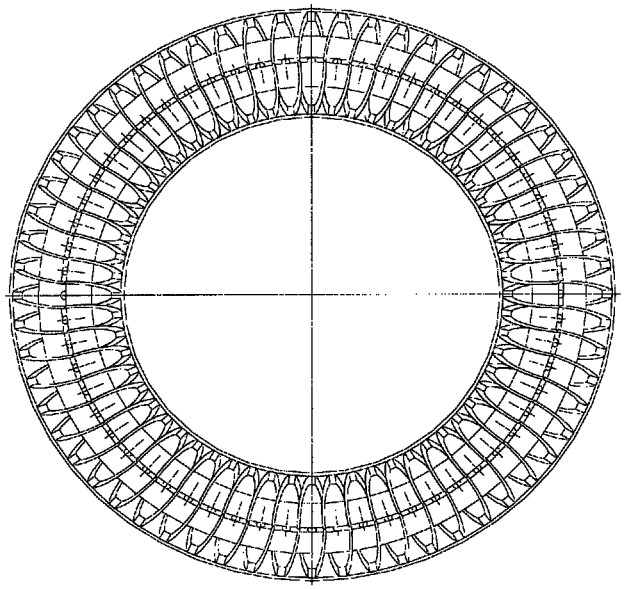
FIG. 4 is a top schematic view showing the structure of a guiding spiral rib structure of the heating device for the annular component according to the second embodiment of the present application.
Figure 5:
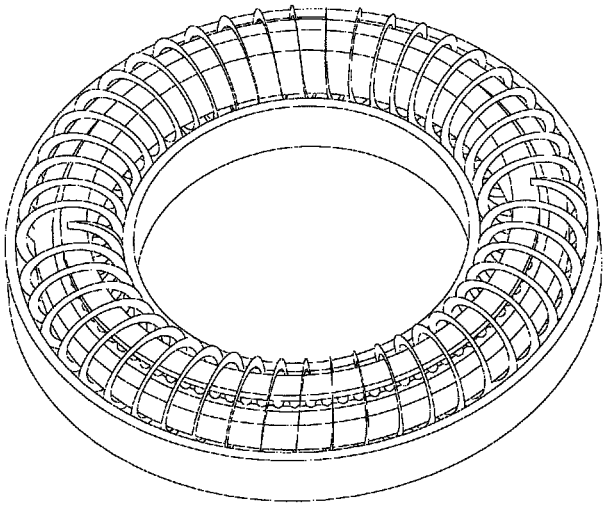
FIG. 5 is a perspective schematic view showing the structure of the guiding spiral rib structure of the heating device for the annular component according to the second embodiment of the present application.

Furthermore, FIG. 4 is a top schematic view showing the structure of the guiding spiral rib structure of the heating device for the annular component according to the second embodiment of the present application, and FIG. 5 is a perspective schematic view showing the structure of the guiding spiral rib structure of the heating device for the annular component according to the second embodiment of the present application. FIGS. 4 and 5 show the structure of the guiding spiral rib structure according to this embodiment in different view angles.

The guiding spiral rib structure 5 may be integrally formed on an inner wall of the annular cavity 3, and may also be separately manufactured, and the separately manufactured guiding spiral rib structure 5 is fixed to the inner wall of the annular cavity 3 after the annular cavity 3 is manufactured.

In this embodiment, in the interior of the annular cavity 3, two gas flow passages with a same length are formed between the gas flow inlet 301 and the gas flow outlet 302, and the guiding spiral rib structure of the two gas flow passages may be symmetrical about an axis, and the axis of symmetry is a straight line in which the gas flow inlet and the gas flow outlet are. Specifically, as shown in FIG. 4, in the two gas flow passages, the guiding spiral rib structures 5 of the two gas flow passages have opposite directions of spiral, and spiral lines of the guiding spiral rib structures 5 of the two gas flow passages are symmetrical along an inner axis of the annular cavity.

Such symmetrical structures have the following advantages: taking the circular ring shaped cavity as an example, if the whole circular ring shaped annular cavity is divided into two half-circle-ring shaped cavities taken the diameter, in which the gas flow inlet 301 and the gas flow outlet 302 are located, as a boundary line, each half-circle ring cavity corresponds to one gas flow passage, and if the spiral lines of the guiding spiral rib structures 5 of the two gas flow passages have symmetrical structures, manufacturing of the two half-circle ring cavities may be achieved by adopting one mold, thus there is no need to design two molds.

Third Embodiment

Based on the second embodiment, the structure of the guiding spiral rib structure 5 is also further improved, which is described in detail hereinafter.

During the process of hot gas flow moving from the gas flow inlet 30/ to the gas flow outlet 302, the temperature of the hot gas flow may be decreased, and a heat exchanging capacity between heated annular component 4 and the hot gas flow may be gradually reduced, and a condition of non-uniform heating may occur.

According to Newton's law of cooling, $$ø = A \times h \times (T - Tw) \quad \text{formula (1)}$$

In this embodiment, ø is a heat exchange rate between the hot gas flow and a surface of the annular component 4, A is an effective heat releasing area through which the hot gas flow is contact with the surface of the annular component 4, T is a temperature of the hot gas flow, Tw is a temperature of the surface of the annular component 4, and h is a surface heat transfer coefficient (usually referred to as a surface heat transfer rate). According to formula (1), A is a relatively fixed value, hence, the heat exchange rate ø between the hot gas flow and the surface of the annular component 4 depends on the product of the temperature difference (T−Tw) between the temperature T of the hot gas flow and the temperature Tw of the surface of the annular component 4, and the surface heat transfer rate h. In the gas flow passage from the gas flow inlet 301 to the gas flow outlet 302, the temperature T of the hot gas flow is gradually decreased, i.e., the temperature difference (T−Tw) is decreased, thus causes the heat exchange rate a to gradually decrease, and further causes heating of the annular component 4 to be abated along the gas flow passage. Considering this, a technical solution, in which the decrease of the temperature difference (T−Tw) of the hot gas flow is compensated by an increase of the surface heat transfer rate h, is provided according to the present application to keep the heat exchange rate ø approximately unchanged.

Figure 6:
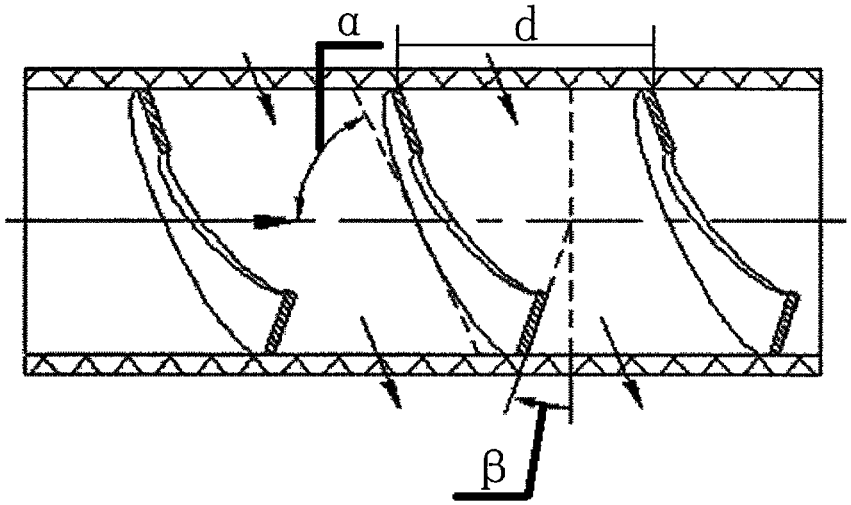
FIG. 6 is a partially sectional schematic view of an annular cavity provided with a guiding spiral rib structure according to a third embodiment of the present application.

Specifically, the surface heat transfer rate h can be changed by changing any one or any two or three of the three parameters i.e. a pitch d, a spiral angle α, and half of thread angle β of the guiding spiral rib 5. As shown in FIG. 6, FIG. 6 is a partially sectional schematic view of an annular cavity provided with the guiding spiral rib structure according to the third embodiment of the present application. Geometrical meanings of the three parameters of the pitch d, the spiral angle α, and the half of thread angle β in this embodiment are shown in the drawing.

By changing these parameters, the surface heat transfer coefficient h may be changed, thus compensating the decrease of the heat exchange rate ø resulted from the decrease of the temperature from the gas flow inlet 301 to the gas flow outlet 302, and further enabling the entire annular component 4 to be uniformly heated, and obtaining approximately uniform heat exchange rates from beginning to end or from the gas flow inlet to gas flow outlet and throughout the entire gas flow passage.

In this embodiment, the gas flow heater 1 heats the gas flow before the gas flow enters into the gas flow passage of the annular cavity. In such a circumstance, the temperature T of the hot gas flow is decreased from the gas flow inlet 301 to the gas flow outlet 302. For solving this issue, in this embodiment, the guiding spiral rib structure 5 is improved from the following three aspects, and improving of the guiding spiral rib structure may be implemented from any one of the three aspects, or any two of the three aspects, or from all of the three aspects simultaneously.

1. The pitch d of the guiding spiral rib structure 5 is decreased from the gas flow inlet 301 to the gas flow outlet 302, preferably, the pitch d is gradually decreased. The decreasing of the pitch of the guiding spiral rib 5 enables a flow rate of the hot gas flow to be increased, and simultaneously forces the hot gas flow to get close to the surface of the annular component 4, thus functioning to increase the surface heat transfer coefficient h between the hot gas flow and the annular component 4. By decreasing of the pitches d of the guiding spiral rib structure 5, the hot gas flow is accelerated, and the heat released to the surface of the annular component 4 is increased, thus compensates the decrease of heat released to the surface of the annular component 4 caused by decreasing of the temperature of the gas flow in the gas flow passage from the gas flow inlet 301 to the gas flow outlet 302, allowing the annular component 4 to be uniformly heated, and the overall temperature of the annular component 4 to reach uniformity. That is, in the process of changing the spiral pitch, the flow rate of the hot gas flow around the annular component 4 is increased, and the Reynolds number is increased correspondingly, the Nusselt number is increased with the increase of the Reynolds number, and the surface heat transfer coefficient is increased in proportion to the increasing of the Nusselt number, thus finally increasing the heat released to the surface of the annular component 4, i.e., the heat exchange rate ø.

2. The spiral angle α of the guiding spiral rib structure 5 is increased from the gas flow inlet 301 to the gas flow outlet 302, and preferably, the spiral angle α is gradually increased. The increasing of the spiral angle α of the guiding spiral rib structure 5 may force the hot gas flow to get close to the center axis and to approach the surface of the annular component 4, and may also allow the flow rate of the hot gas flow to increase, thus functioning to increase the surface heat transfer coefficient h between the hot gas flow and the annular component 4. That is, the Nusselt number is directly proportional to, a cosine function value of the spiral angle α to the power of 0.75, the increase of the spiral angles α may lead to the increase of the Nusselt number, and the surface heat transfer coefficient h increases in proportion to the increase of the Nusselt number, thus finally increasing the heat released to the surface of the annular component 4, i.e., the heat exchange rate ø.

3. The half of thread angle β of the guiding spiral rib structure 5 is decreased from the gas flow inlet 301 to the gas flow outlet 302, and preferably, the half of thread angle β decreases gradually. As shown in FIG. 6, the half of thread angle of the guiding spiral rib structure 5 is an included angle β formed between the guiding spiral rib structure 5 and a plane perpendicular to the axis of the annular cavity. The half of thread angle decreases to allow a field synergy angle to be decreased. The decreasing of the half of thread angle β may also force the hot gas flow to approach the center axis and to approach the surface of the annular component 4, thus functioning to increase the surface heat transfer coefficient h, and further increasing the heat releasing rate to the surface of the annular component 4, i.e., the heat exchange rate ø.

Figure 7:
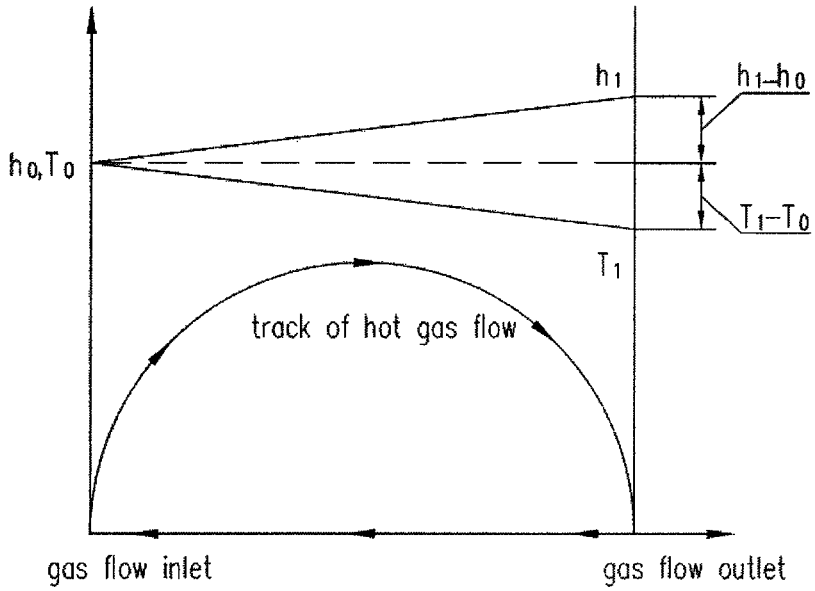
FIG. 7 is a schematic view showing a change relationship between a surface heat transfer coefficient and a temperature of hot gas flow according to the third embodiment of the present application.

The principles of adjusting the surface heat transfer coefficient h via the three parameters of the pitch d, the spiral angle α, and the half of thread angle β to further adjust the heat exchange rate ø are respectively described above. The technical solution of compensating the heat exchange rate ø by changing the surface heat transfer coefficient h is further described in conjunction with FIG. 7 hereinafter. As shown in FIG. 7, FIG. 7 is a schematic view of the change relationship between the surface heat transfer coefficient and the temperature of the hot gas flow according to the third embodiment of the present application. In FIG. 7, half circular shaped curve with arrows represents a moving track of the hot gas flow from the gas flow inlet to the gas flow outlet. Assuming the temperature of the gas flow at the gas flow inlet is $T_0$, and with the hot gas flow flowing in the annular cavity, the temperature of the hot gas flow decreases gradually, and decreases to $T_i$ when the hot gas flow reaches the gas flow outlet, in this way, there is a temperature difference of $T_0$-$T_i$ between the gas flow inlet and the gas flow outlet, the change trend of the temperature in the entire gas flow passage is shown by a line segment below a dotted line in FIG. 7, and the temperature difference may cause the heat exchange rate ø to decrease. When the guiding spiral rib structure 5 is designed, the pitch d, the spiral angle α and the half of thread angle β are designed corresponding to the change of the temperature. That is, by decreasing the pitch of the guiding spiral rib structure 5, and/or by increasing the spiral angle of the guiding spiral rib structure 5, and/or by decreasing the half of thread angle of the guiding spiral rib structure 5, thus the surface heat transfer coefficient h is indirectly adjusted, which allows the surface heat transfer coefficient h to be gradually increased in the entire gas flow passage, and have a change trend shown by a line segment above the dotted line in FIG. 7. That is, the surface heat transfer coefficient is h at the gas flow inlet, and is increased to $h_i$ at the gas flow outlet, thus there is a difference of $h_o$-$h_i$ between the gas flow inlet and the gas flow outlet. Therefore, in the entire heat exchanging process of the gas flow passage, the decrease of the temperature difference between the gas flow and the surface of the heated annular component is compensated by the gradual increase of the surface heat transfer coefficient, i.e., though (T−Tw) in formula (1) decreases, the surface heat transfer coefficient h correspondingly increases, thus obtaining a heat exchange rate ø which is approximately uniform at the beginning, at the end and in the middle of the heat exchanging process.

Therefore, in this embodiment, the annular component 4 is uniformly heated in the whole gas flow passage, and phenomena of asymmetrical deformation and warping of the annular component 4 generated by heat stress due to the temperature difference in the conventional technology are avoided.

In addition, change rules of the pitch d, the spiral angle α and the half of thread angle β according to the present application are not limited to the above forms, and may be flexibly set according to a practical heating environment, i.e., any one or more of the pitch d, the spiral angle α and the half of thread angle β is changed to allow the change trends of the surface heat transfer coefficient and the temperature of the gas flow in the gas flow passage to be opposite to each other. In this way, the heat exchange rate ø is controlled by indirectly adjusting the surface heat transfer coefficient h.

Therefore, by adjusting one or more of the three parameters, the non-uniform heating caused by the change of temperature in the gas flow passage is adjusted. For example, in the case that a gas flow heater 1 is provided inside the annular cavity, the change of the temperature is not simply decreased from the gas flow inlet 301 to the gas flow outlet 302, but may be in a situation that the temperature in the gas flow passage increases first and then decreases. For solving such issues, any one or more of the pitch d, the spiral angle α and the half of thread angle β of the guiding spiral rib structure 5 may be correspondingly changed to compensate the change of the temperature of the gas flow in the gas flow passage.

Regarding the specific design method of the pitch d, the spiral angle α and the half of thread angle β of the guiding spiral rib structure 5, simulation and calculation may be performed by establishing a numerical heat transfer mode via a simulation test, which is not described in further detail hereinafter.

In this embodiment, the technical idea is proposed that the guiding spiral rib structure is provided in the annular cavity, one or more of the three parameters, namely, the pitch d, the spiral angle α and the half of thread angle β, of the guiding spiral rib structure 5 is adjusted to adjust the surface heat transfer coefficient h, and further to adjust the heating condition of the annular component, and such a technical idea has never been raised in the technical field of the conventional large heating device. In embodiments of the present application, heat transfer theory is fully utilized and a special flow guiding structure design is incorporated. In the entire gas flow passage, the flow condition of the gas flow is adjusted reasonably, and the heat exchanging condition are more accurately adjusted and controlled, to enable the heat exchanging efficiency and heating uniformity of the annular component to be remarkably improved, at this point, the present application has a pioneering significance.

Fourth Embodiment

In the above embodiments, the heating device according to the present application is described in detail, in addition, the annular cavity of the heating device may be applied as an separate component, and the annular cavity is also a technical solution, the protection of which is sought for by the present application.

The annular cavity of the heating device according to the present application is shown in FIGS. 3, 4, and 5, the annular cavity is configured to accommodate an annular component that is heated, and an outer wall of the annular cavity is provided with a gas flow inlet and a gas flow outlet.

The annular cavity of the heating device according to this embodiment has the following technical effects.

1) Compared with a furnace cavity of a heating furnace in the conventional technology, a flow circulation passage of the gas flow of the center area encircled by the annular component is saved in the annular cavity according to the present application, and a gas flow passage may be concentrated near the annular component, thus enabling the heat exchange to be more efficient, and reducing the waste of heat energy.

2) Compared with the heating furnace in the conventional technology, the material consumed in manufacturing the body of the furnace cavity is reduced, thus the manufacturing cost is decreased.

Further, a guiding member may be provided in the annular cavity, the guiding member enables the gas flow to uniformly move along a surface of the annular component. By providing the guiding member in the annular cavity, the flowing manner of the gas flow is controlled, thus enabling the annular component to be uniformly heated, and improving the heating efficiency.

Preferably, the guiding member is embodied as a guiding spiral rib structure. By providing the guiding spiral rib structure, a track of the hot air flow entering into the annular cavity changes into a spiral pipe shaped movement around the annular component, thus the annular component can be more efficiently and uniformly heated.

Since the annular cavity and the guiding spiral rib structure thereof have been fully illustrated in the above embodiments, all of the contents regarding the annular cavity in the above embodiments can be regarded as contents related to the annular cavity in this embodiment, which are not described in detail hereinafter.

The heating device of the annular component according to the present application is described in detail in the above embodiments. It should be noted that, the heating device for the annular component and the annular cavity of the heating device according to the embodiments of the present application may be used to heat various kinds of annular components, including but being not limited to a circular ring shaped component, an elliptical annular component, a rectangular annular component, and a triangular annular component etc., correspondingly, the annular cavity may be made in the above various annular shapes. Preferably, the heating device according to the embodiments of the present application is suitable for heating large bearing type components. In addition, a cross section of the annular cavity is not limited to the circular shape as well, and may be made in any shape according to the shape of the annular component.

Though the present application has been represented and described by reference of embodiments, it should be understood by those skilled in the art that, various modifications and variations may be made to these embodiments without departing from the spirit and scope of the present application defined by the claims.

The invention claimed is:

1. A heating device for an annular component, configured to heat the annular component via hot gas flow, comprising a gas flow heater, a draught fan, and a hollow annular cavity configured to accommodate the annular component, wherein an outer wall of the annular cavity is provided with a gas flow inlet and a gas flow outlet, the draught fan is arranged between the gas flow inlet and the gas flow outlet and is arranged outside the hollow annular cavity, the gas flow heater is arranged inside or outside the hollow annular cavity, the gas flow heater heats a gas flow, and the draught fan enables the gas flow to enter into the gas flow inlet, pass through a gas flow passage in the annular cavity, and be discharged via the gas flow outlet, wherein the annular cavity is formed by engaging an upper annular cavity and a lower annular cavity, the upper annular cavity is formed by engaging a plurality of upper annular cavity units, and the lower annular cavity is formed by engaging a plurality of lower annular cavity units.

2. The heating device for the annular component according to claim 1, wherein a guiding member is provided in the annular cavity, and the guiding member is configured to guide the gas flow to move along a surface of the annular component.

3. The heating device for the annular component according to claim 2, wherein the guiding member is a guiding spiral rib structure.

4. The heating device for the annular component according to claim 3, wherein the gas flow heater heats the gas flow before the gas flow enters into the gas flow passage in the annular cavity.

5. The heating device for the annular component according to claim 4, wherein, a pitch of the guiding spiral rib structure is decreased from the gas flow inlet to the gas flow outlet; and/or a spiral angle of the guiding spiral rib structure is increased from the gas flow inlet to the gas flow outlet; and/or half of thread angle of the guiding spiral rib structure is decreased from the gas flow inlet to the gas flow outlet.

6. The heating device for the annular component according to claim 3, wherein any one or more of the pitch, the spiral angle, and the half of thread angle, of the guiding spiral rib structure varies to allow a change trend of a surface heat transfer coefficient to be opposite to a change trend of a temperature of the gas flow in the gas flow passage.

7. The heating device for the annular component according to claim 3, wherein the guiding spiral rib structure is integrally formed on an inner wall of the annular cavity.

8. The heating device for the annular component according to claim 3, wherein in the annular cavity, two gas flow passages with a same length are formed between the gas flow inlet and the gas flow outlet, the guiding spiral rib structures of the two gas flow passages are symmetrical about an axis, and the axis of symmetry is a straight line in which the gas flow inlet and the gas flow outlet are.

9. The heating device for the annular component according to claim 1, wherein the gas flow inlet and the gas flow outlet are arranged in an outer wall of an inner ring of the annular cavity, the gas flow heater and the draught fan are arranged at an inner side of the annular cavity, and a closed gas flow circulation passage is formed between the gas flow inlet, the inner cavity of the annular cavity, the gas flow outlet, the draught fan and the gas flow heater.

10. The heating device for the annular component according to claim 9, wherein in the annular cavity, two gas flow passages with a same length are formed between the gas flow inlet and the gas flow outlet.

11. The heating device for the annular component according to claim 9, wherein the gas flow is air flow, and an air filter is provided at the gas flow outlet.

* * * * *